US009822632B2

(12) United States Patent
Kjørholt et al.

(10) Patent No.: US 9,822,632 B2
(45) Date of Patent: Nov. 21, 2017

(54) METHOD OF PRESSURE TESTING A PLUGGED WELL

(71) Applicant: STATOIL PETROLEUM AS, Stavanger (NO)

(72) Inventors: Halvor Kjørholt, Trondheim (NO); Gisle Stjern, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 230 days.

(21) Appl. No.: 14/764,934

(22) PCT Filed: Jan. 31, 2013

(86) PCT No.: PCT/EP2013/051942
§ 371 (c)(1),
(2) Date: Jul. 30, 2015

(87) PCT Pub. No.: WO2014/117848
PCT Pub. Date: Aug. 7, 2014

(65) Prior Publication Data

US 2015/0361782 A1 Dec. 17, 2015

(51) Int. Cl.

| | |
|---|---|
| ***E21B 47/06*** | (2012.01) |
| ***E21B 33/13*** | (2006.01) |
| ***E21B 33/134*** | (2006.01) |
| ***E21B 47/10*** | (2012.01) |
| ***E21B 33/124*** | (2006.01) |

(52) U.S. Cl.
CPC ..... *E21B 47/06* (2013.01); *E21B 33/124* (2013.01); *E21B 33/13* (2013.01); *E21B 33/134* (2013.01); *E21B 47/1025* (2013.01)

(58) Field of Classification Search
CPC ..... E21B 47/06; E21B 33/124; E21B 33/13; E21B 33/134; E21B 47/1025
See application file for complete search history.

(56) References Cited

U.S. PATENT DOCUMENTS

| | | | | |
|---|---|---|---|---|
| 2,591,807 A | | 4/1952 | Greene | |
| 2,696,258 A | | 12/1954 | Greene | |
| 2,696,259 A | | 12/1954 | Greene | |
| 2,738,013 A | * | 3/1956 | Lynes | E21B 33/1216 166/147 |
| 2,918,124 A | | 12/1959 | Spearow | |
| 2005/0028980 A1 | | 2/2005 | Page et al. | |

FOREIGN PATENT DOCUMENTS

| | | |
|---|---|---|
| GB | 2 407 835 A | 5/2005 |
| WO | WO 2012/096580 A1 | 7/2012 |

* cited by examiner

*Primary Examiner* — Yong-Suk (Philip) Ro
(74) *Attorney, Agent, or Firm* — Birch, Stewart, Kolasch & Birch, LLP

(57) ABSTRACT

A method of plugging a well extending into a hydrocarbon bearing formation facilitates temporary or permanent abandonment of the well. The method includes forming two or more plugs within the well, the plugs being formed at longitudinally spaced apart locations whilst providing a fluid communication path from a region above the topmost plug to the or each space between adjacent plugs. This configuration facilitates pressure testing of one or more of the plugs by conducting fluid through said path.

9 Claims, 2 Drawing Sheets

METHOD OF PRESSURE TESTING A PLUGGED WELL

TECHNICAL FIELD

The present invention relates to a method of pressure testing a plugged well extending into a hydrocarbon bearing formation. The invention also relates to a method of plugging a well, for example, by placement of a high quality sealant, to facilitate subsequent pressure testing.

BACKGROUND

Oil and gas wells have in general three different purposes, as producers of hydrocarbons, injectors of water or gas for reservoir pressure support or for depositing purposes, or as exploration wells. At some point it is likely to be necessary to satisfactorily plug and seal these wells, e.g. after the wells have reached their end-of life and it is not economically feasible to keep the wells in service (so-called "plug and abandon"), or for some temporary purpose (e.g. "slot recovery"). Plugging of wells is performed in connection with permanent abandonment of wells due to decommissioning of fields or in connection with permanent abandonment of a section of well to construct a new wellbore (known as side tracking or slot recovery) with a new geological well target.

A well is constructed by a hole being drilled down into the reservoir using a drilling rig and then sections of steel pipe, casing or liner are placed in the hole to impart structural integrity to the wellbore. Cement is placed between the outside of the casing or liner and the bore hole and then tubing is inserted into the casing to connect the wellbore to the surface. For ease of reference, all of these entities inserted into the well are referred to here as "tubulars". When the reservoir is to be abandoned, either temporarily or permanently, a well barrier must be established across the full cross-section of the well. This is generally achieved by removal of the tubulars from the well bore by pulling the tubulars to the surface or by section milling. Well barriers are then established across the full cross-section of the well, in order to isolate the reservoir(s) and prevent flow of formation fluids between reservoirs or to the surface. It is necessary to remove the tubulars from the wellbore in the case that proper quality of the sealant (e.g. cement) behind the tubular(s) cannot be determined.

To save having to remove an entire length of tubular from a well, a tool may be inserted into the well to cut the tubulars at a point beneath that at which the plug is to be formed, and only the upper detached part of the tubulars removed from the well. It is also possible to use a milling tool to mill away a part of the tubulars at the location where the plug is to be formed.

Attempts have been made to increase the efficiency of the method of abandonment. For example, GB2407835 describes wellbore sealing wherein explosive charges are used to perforate a lower end of the tubing and then sealing fluid is pumped through the perforations so as to plug the well around the bottom end of the tubing. A similar approach is described in WO2012096580.

U.S. Pat. No. 2,591,807 relates to an apparatus that uses relatively low and high velocity explosive charges spaced at opposing ends of a container full of cement for placing in a zone of a wellbore whereby, upon ignition, cement is forced downwardly and outwardly to release cement into the cavity between the tubing and formation. U.S. Pat. No. 2,696,258 and U.S. Pat. No. 2,696,259 relate to an apparatus for depositing cement in a zone wherein the cement is contained within an elongated container and a gas generating charge is ignited to displace the cement through a lower outlet of the container into the zone. The charge expands the container into sealing contact with the casing, while at the same time rupturing the end of a tubular body to release cement into the wellbore.

Regulations may require that an abandoned well be plugged so as to seal the well over at least some specified longitudinal extent, e.g. greater than 50 meters. An improperly abandoned well is a serious liability so it is important to ensure that the well is adequately plugged and sealed. However, as it can be difficult to accurately determine the quality of a well plug, regulations will typically over specify plug requirements by some significant margin. In any case, even when a plug meets the specified requirements there may be a risk of failure for any number of reasons.

In order to determine the integrity of a well plug it is desirable to perform pressure testing. This is relatively easy to achieve from above the plug. However, it is currently not possible to perform pressure testing of a plug from below.

SUMMARY

It is an object of the present invention to provide an improved method of testing the integrity of a well plug. It is a further objective to provide a method of plugging a well to facilitate such improved testing.

According to a first aspect of the present invention there is provided a method of plugging a well extending into a hydrocarbon bearing formation to facilitate temporary or permanent abandonment of the well. The method comprises forming two or more plugs within the well, the plugs being formed at longitudinally spaced apart locations whilst providing a fluid communication path from a region above the topmost plug to the or each space between adjacent plugs. This configuration facilitates pressure testing of one or more of the plugs by conducting fluid through said path.

The method may comprise partially or completely filling the or each space intermediate adjacent plugs with a permeable material or void making material or device. The permeable material may be a particulate material, for example sand or proppant.

The step of providing a fluid communication path may comprise locating one or more pressure testing tubes within the or each plug located directly above an intermediate space.

The method may further comprise pressure testing one or more of the plugs by conducting fluid through said path. The method may further comprise plugging the fluid communication path subsequent to a pressure testing procedure.

According to a second aspect of the present invention there is provided a method of pressure testing a plug formed during plugging of a well using the method of any one of the preceding claims. The method comprises passing a fluid through said fluid communication path in order to establish an elevated or reduced pressure within one or more spaces intermediate the adjacent plugs, and monitoring the pressure or leakage between the plugs and/or monitoring pressure above or below one or more of the plugs to determine plug integrity.

DETAILED DESCRIPTION

As has already been discussed above, it is often necessary to either temporarily or permanently plug a well, extending into a hydrocarbon formation, in order to prevent fluids from leaking out of, or indeed into, the formation. This is commonly achieved by forming a cement plug within the well. Other materials, such a epoxy resins, may be used instead of cement. Typically, in order to achieve seal with sufficient integrity, a plug may extend over many tens of meters.

Figure 1:
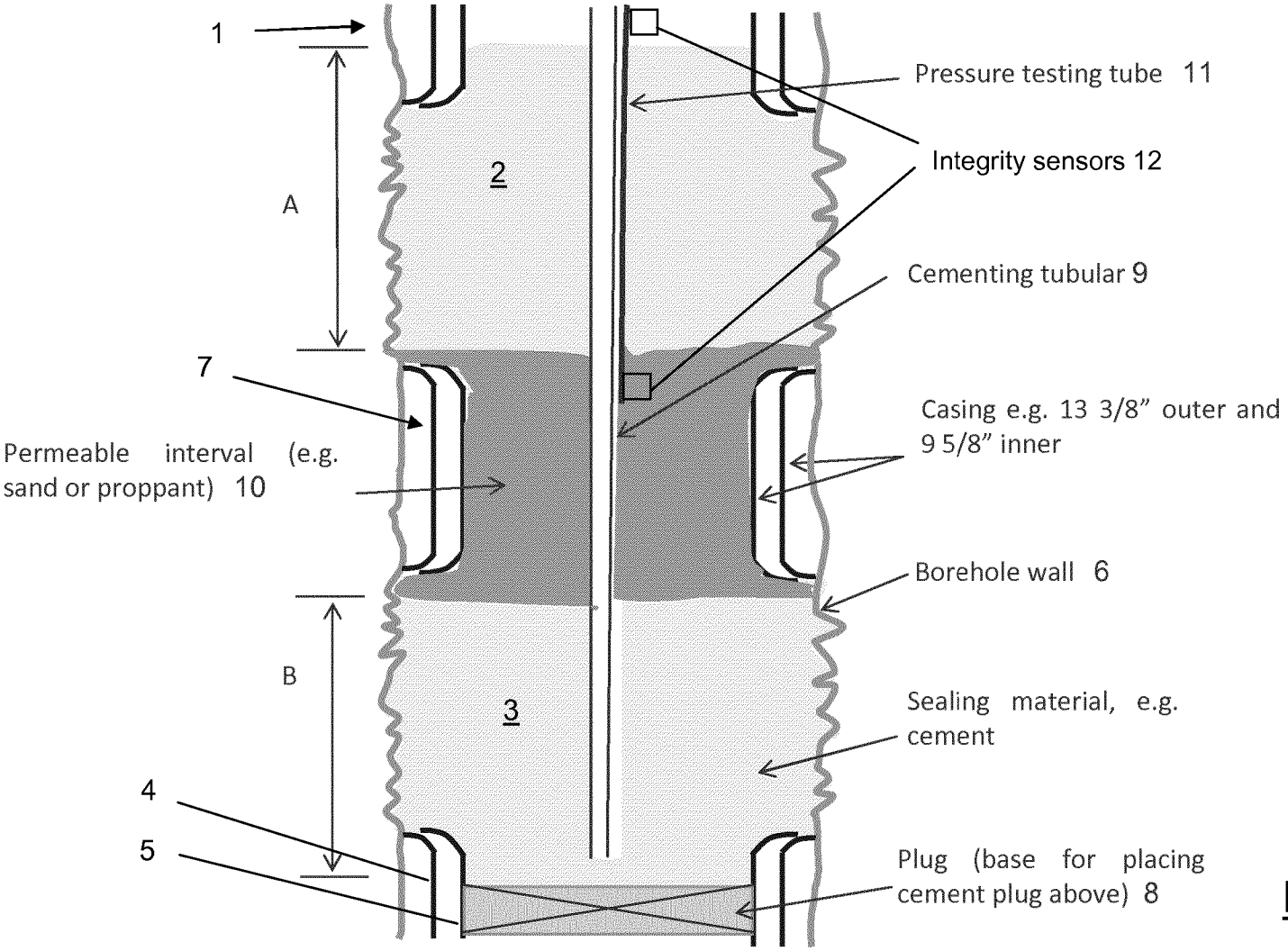
FIG. 1 illustrates schematically a downhole region of a well within which two plugs have been formed.

FIG. 1 illustrates a region of a well 1 in which a well seal is achieved using a pair of axially spaced cement plugs, including an upper plug 2 and a lower plug 3. Each plug may have a longitudinal extent of at least 0.2 meters, although possibly much greater, e.g. 50 meters or more. Techniques used to form the plugs individually, e.g. cutting or milling, are known, but may comprise cutting or grinding away tubulars, including casing, at least in those well sections where the plugs are to be formed. FIG. 1 illustrates that a pair of casings 4,5, as well as the surrounding cement or mud in the annuli between the tubulars or between the outer tubular and formation 6, have been removed from the locations where the plugs are formed. Other elements including production tubing and cables may be removed prior to the selective removal of the tubings. FIG. 1 further illustrates sections of casing and liner 7 that remain between the plug locations. It is noted that, in some cases, the casings may be pulled out of the well in their entirety, or at least from that region above where the lower plug is to be formed.

During preparation of the well for plug formation, a plug support or base 8 is located within the well, typically with the remaining tubulars. A cementing tubular 9, used to deliver cement or other sealant to the plug locations, may remain within the well after plug formation. [In this case, the cementing/sealant tubular will probably be filled with sealant or other mechanical devices in order to maintain plug integrity.]

Figure 2:
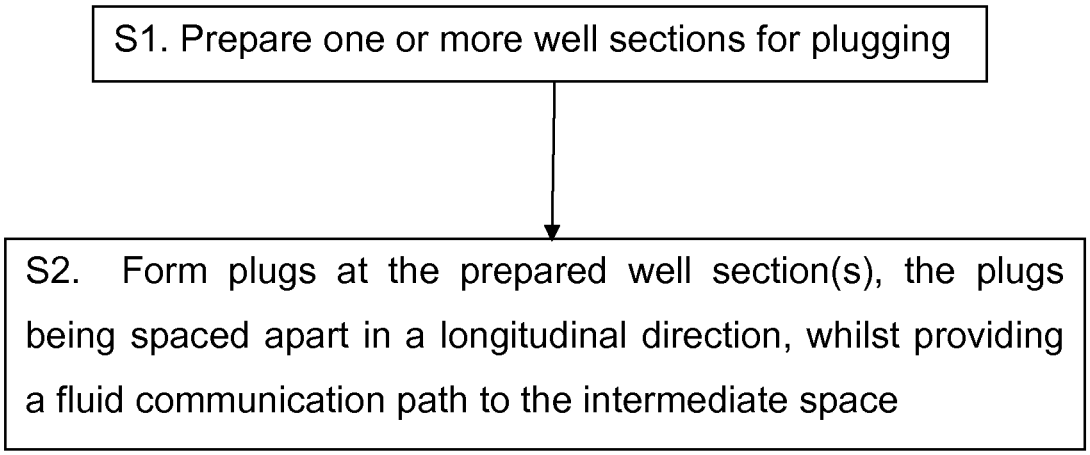
FIG. 2 is a flow diagram illustrating a method of forming the plugs shown in FIG. 1.

FIG. 1 illustrates an intermediate space 10 that is formed between the upper and lower plugs 2,3. This space is preferably filled with a permeable, e.g. particulate, material such as sand, proppant or other permeable or void making material/device, although it is possible that the space may be empty (except perhaps from some debris). The material is such that it will conduct a force, generated within the space, to the upper and lower plugs. FIG. 2 further illustrates a part of a pressure testing tube 11 that extends from the surface of the well, through the upper plug 2, to a location within the intermediate space 10. This tube is kept open during setting of the plug material, but may be filled following completion of pressure testing. Alternatively the tube may be extracted after pressure testing and the resulting void filled with sealant.

Turning now to the pressure testing itself, this involves introducing fluid into the space 10 via the pressure testing tube 11. This fluid could, for example, be drilling fluid or other liquid material. The fluid is introduced to the tube 11 at the surface, e.g. from a support platform or other vessel, using appropriate valves and pumps, and fills the space 10, e.g. filling the voids within the permeable material. The fluid pressure at the surface is monitored, e.g. to ensure that it can exceed the highest possible pressure that might arise beneath the plug. This allows the pressure in the intermediate space 10 to be calculated. Alternatively, pressure sensors may be located within the intermediate space and data fed back to the surface, e.g. to allow pressure increase and decrease within one or more spaces to be monitored. Appropriate sensors are mounted on the testing tube 11. These sensors could be, for example, pressure sensors, chemical sensors, optical sensors, acoustic sensors, etc, or indeed any combination of these sensor types. The sensors are configured to determine the integrity of the upper plug 2, and possibly to some extent the integrity of the lower plug 3, during and after application of the elevated pressure to the intermediate space 10.

Whilst FIG. 1 illustrates only two plugs, a series of three or more plugs may be formed within the well. In this case, a separate pressure testing tube may be provided to each intermediate space. Alternatively, a common pressure testing tube may be used for all intermediate spaces, possibly using an arrangement of valves to control the flow of fluid to individual spaces. In this case, sensors may be arranged within each intermediate space, as well as above the topmost plug, in order to allow pressure testing of all or some of the plugs, except the lower one, from below.

FIG. 2 is a flow diagram further illustrating the method of plugging a well to facilitate subsequent plug integrity testing. The steps of the method include preparing one or more sections of the well for plugging (S1). As described above, this step involves removing casing and cement sections. Two or more plugs are then formed in the prepared section(s), leaving a space between the plugs whilst at the same time providing a fluid communication path to the intermediate space(s). Typically, the pressure testing tube will be inserted before the plug cement hardens, although in some circumstances it may be inserted after, e.g. by drilling through the plug.

Figure 3:
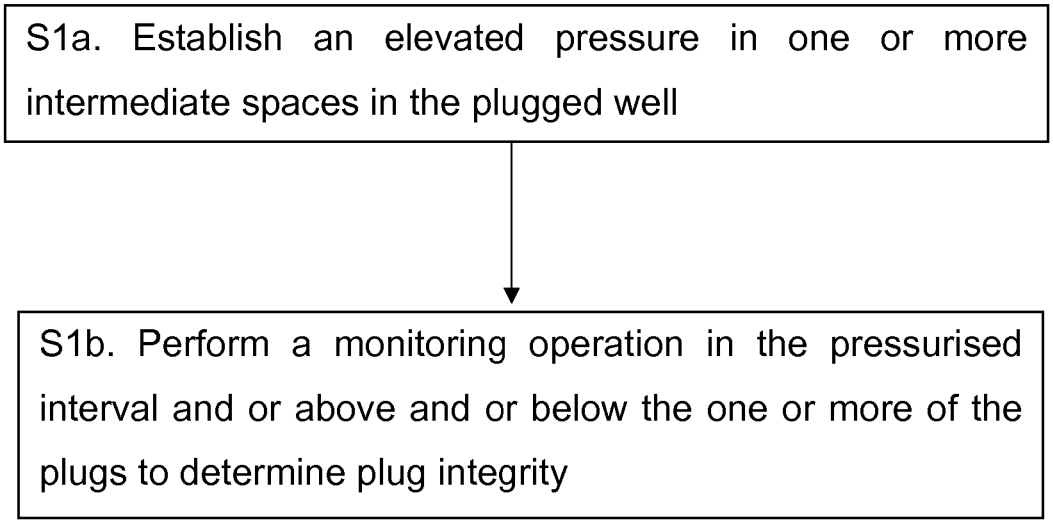
FIG. 3 is a flow diagram illustrating a method of pressure testing one or both of the plugs of FIG. 1.

FIG. 3 is a further flow diagram illustrating the method for performing pressure testing once the plug configuration has been installed. This involves pumping fluid through the fluid communication path to establish an elevated pressure within the intermediate space(s) (S1*a*), and performing a monitoring operation in the pressurised interval and or above and or below one or more of the plugs (S2*b*). Based upon the results of this monitoring, an assessment of plug integrity can be made.

It will be appreciated by the person of skill in the art that various modifications may be made to the above described embodiments without departing from the scope of the present invention.

The invention claimed is:

1. A method of plugging a well extending into a hydrocarbon bearing formation to facilitate temporary or permanent abandonment of the well, the method comprising the step of:

pumping a sealant into the well to form two or more plugs within the well, the plugs being formed at longitudinally spaced apart locations while providing a fluid communication path from a region above a topmost plug of said two or more plugs to at least one space between adjacent plugs of said two or more plugs; and pressure testing of one or more of said two or more plugs by conducting fluid through said fluid communication path.

2. The method according to claim 1, wherein each plug has a length of at least 0.2 meters.

3. The method according to claim 1, further comprising the step of partially or completely filling said at least one space with a permeable material or void making material or device.

4. The method according to claim 3, wherein said permeable material is a particulate material.

5. The method according to claim 4, wherein said particulate material is one of sand or proppant.

6. The method according to claim 1, wherein said step of providing the fluid communication path comprises positioning one or more pressure testing tubes within plugs of said two or more plugs located directly above said at least one space.

7. The method according to claim 1, further comprising the step of pressure testing of one or more of the plugs by conducting fluid through said fluid communication path.

8. The method according to claim 7, further comprising the step of plugging the fluid communication path subsequent to said pressure testing.

9. A method of pressure testing a plug formed during plugging of a well using the method of claim 1, the method comprising the steps of:

passing a fluid through said fluid communication path in order to establish an elevated or reduced pressure within said at least one space; and monitoring the pressure or leakage at at least one of the following locations to determine the integrity of at least one of said two or more plugs: between said adjacent plugs and above or below one or more of the plugs.

* * * * *